US007591707B2

(12) United States Patent
Yu et al.

(10) Patent No.: US 7,591,707 B2
(45) Date of Patent: Sep. 22, 2009

(54) UNDERWIRE ASSEMBLY FOR BRASSIERE, BRASSIERE USING THE SAME, AND PROCESS FOR PRODUCING AND WEARING THE BRASSIERE

(75) Inventors: Winnie Yu, Kowloon (CN); Jintu Fan, Kowloon (CN); Rong Zheng, Kowloon (CN)

(73) Assignee: The Hong Kong Polytechnic University, Hong Kong SAR (CN)

( * ) Notice: Subject to any disclaimer, the term of this patent is extended or adjusted under 35 U.S.C. 154(b) by 0 days.

(21) Appl. No.: 11/452,424

(22) Filed: Jun. 14, 2006

(65) Prior Publication Data

US 2007/0293127 A1 Dec. 20, 2007

(51) Int. Cl.
*A41C 3/14* (2006.01)

(52) U.S. Cl. ..... 450/52; 450/51; 450/41

(58) Field of Classification Search ..... 450/39–53; 528/76

See application file for complete search history.

(56) References Cited

U.S. PATENT DOCUMENTS

| | | | | |
|---|---|---|---|---|
| 5,784,737 | A * | 7/1998 | Tsuji | 12/142 E |
| 6,346,028 | B1 * | 2/2002 | Fildan et al. | 450/41 |
| 6,439,959 | B1 * | 8/2002 | Magrone et al. | 450/41 |
| 6,439,960 | B1 * | 8/2002 | Fildan et al. | 450/41 |
| 6,447,365 | B1 * | 9/2002 | Powell et al. | 450/41 |
| 6,583,194 | B2 * | 6/2003 | Sendijarevic | 521/172 |
| 6,720,402 | B2 * | 4/2004 | Langer et al. | 528/76 |
| 6,824,444 | B2 * | 11/2004 | Huang | 450/57 |
| 6,858,680 | B2 * | 2/2005 | Gunatillake et al. | 525/474 |

* cited by examiner

*Primary Examiner*—Gloria Hale
(74) *Attorney, Agent, or Firm*—Jacobson Holman PLLC

(57) ABSTRACT

An underwire assembly for use in a brassiere including an elongate support member of three-dimensional elongate form. The supporting member extends in at least two planes for conforming to an inferior profile of the breast of a wearer.

19 Claims, 5 Drawing Sheets

UNDERWIRE ASSEMBLY FOR BRASSIERE, BRASSIERE USING THE SAME, AND PROCESS FOR PRODUCING AND WEARING THE BRASSIERE

FIELD OF THE INVENTION

The present application relates to underwires used in foundation garments such as brassieres, and to the fitment of brassieres to a wearer

BACKGROUND OF THE INVENTION

Underwires have been provided in brassieres to increase the support along the lower portions of the cup of a brassier. The underwires generally have metallic or plastic members, which have been configured to flex in the plane of the underwire and which have been received in tubular formations provided in the brassiere fabric so as to provide support for the cup and to impart a certain optimum or desired shape to the cup in the plane of the wire. Such underwires are typically rigid, flat steel members having a U-shaped configuration, or are formed from a hard, molded or extruded engineering polymeric material having some inherent shape and degree of curvature. Such conventional designs may not fit the lower profile of the breast of the wearer effectively, whereas the fitness between the brassiere and the lower profile of the breast may be necessary for the comfort and support. Furthermore, such conventional designs may render a wearer feeling somewhat perturbed having had one's breasts deformed in a manner either unbecoming or undesirable to the wearer.

Therefore, it is an object of the present invention to provide an underwire design used in a brassiere, which overcomes at least some of the deficiencies exhibited by some of those of the prior art.

SUMMARY OF THE INVENTION

According to an aspect of the present invention, there is provided an underwire assembly for use in a brassiere comprising an elongate support member of three-dimensional elongate form. The supporting member extends in at least two planes for conforming to an inferior profile of the breast of a wearer.

According to a second aspect of the present invention, there is provided an underwire assembly for use in a brassiere comprising a generally U-shaped wire. The wire is deformable to extend in at least two planes to conform to the inferior profile of the breast of a wearer.

According to a third aspect of the present invention, there is provided a brassiere including a pair of fabric cups joined together at a midsection of the brassiere. Each cup includes a support wire of three-dimensional form, wherein the support wire extends in at least two planes so as to conform to the inferior profile of the breast of a wearer.

According to a fourth aspect of the present invention, there is provided a brassiere including a pair of fabric cups joined together at a midsection of the brassiere. Each cup includes a generally U-shaped wire, wherein the wire is deformable to extend in at least two planes so as to conform to the inferior profile of the breast of a wearer.

According to a fifth aspect of the present invention, there is provided a process for producing a brassiere, the brassiere including a pair of fabric cups joined together at a midsection of the brassiere, and each cup including a wire of three-dimensional form, which is deformed to extend in at least two planes so as to conform to the inferior profile of the breast of a wearer, the processing including deforming the wire in at least two directions, each direction being at an angel to each other such that the wire is deformed in three-dimensions in a manner such that the wire conforms to the inferior profile of the breast of a wearer.

According to a sixth aspect of the present invention, there is provided a process for fitting a brassier to the body of a user, the brassiere including a pair of fabric cups joined together at a midsection of the brassiere, and each cup including a generally U-shaped wire, wherein the wire is formed from a shape memory material and is deformable to extend in at least two planes so as to conform to the inferior profile of the breast of a wearer, the processing including:

heating the wire to a temperature above a glass transition temperature of the shape memory material; and deforming the wire in two directions at an angel to each other such that the wire is deformed in three-dimensions According to a further aspect of the present invention, there is provided a process of fitting a brassier to the body of a user, the process including:

deforming an underwire portion of a cup of the brassier in three-dimensions in a manner so as to conform with the inferior aspect of the associated breast of the user.

Other aspects and advantages of the invention will become apparent from the following detailed description, taken in conjunction with the accompanying drawings, which description illustrates by way of example the principles of the invention.

BRIEF DESCRIPTION OF THE DRAWINGS

The invention now will be described, by way of example only, and with reference to the accompanying drawings in which.

DETAILED DESCRIPTION

Figure 1:
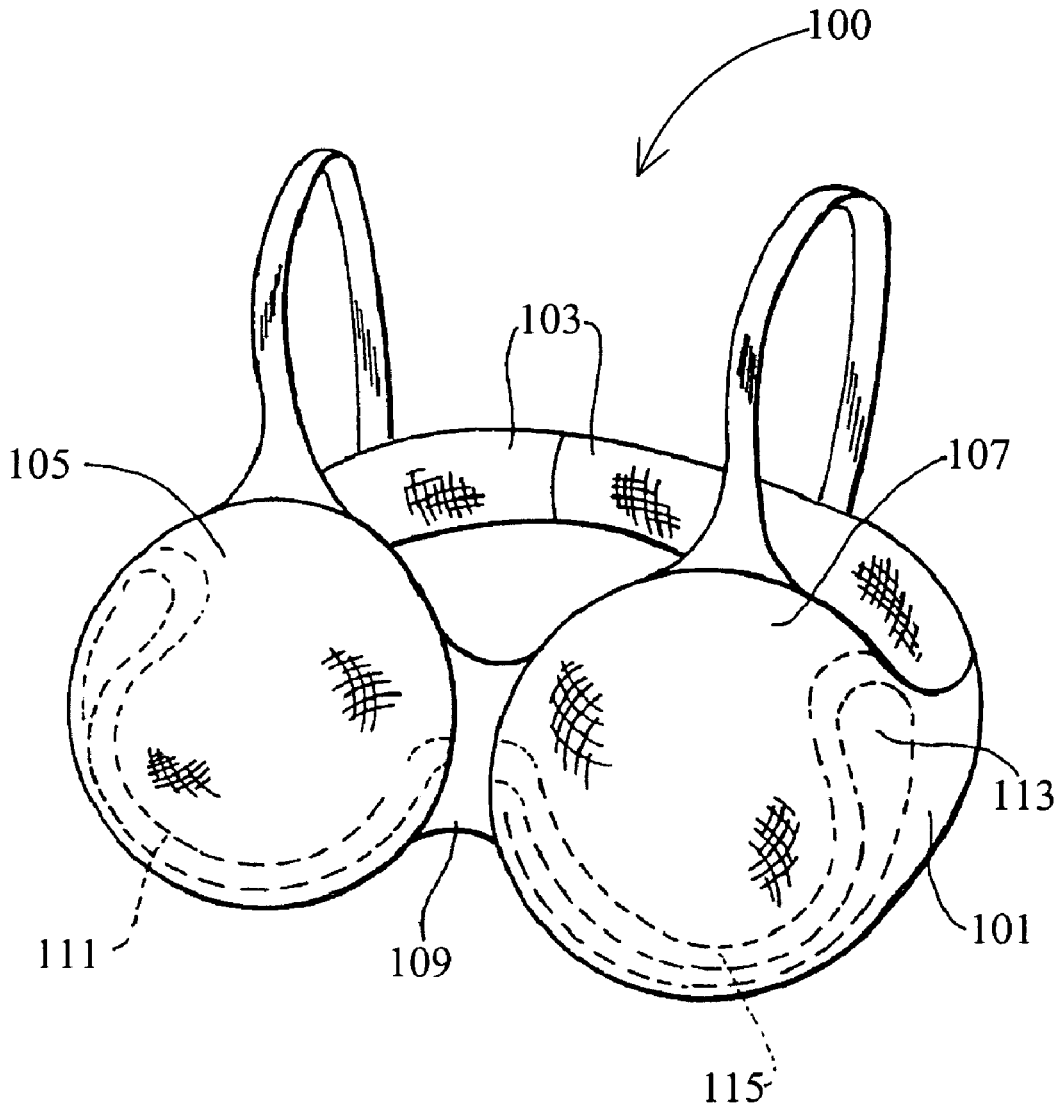
FIG. 1 is a perspective view of a brassiere provided-with the underwire according to the present invention.

FIG. 1 illustrates an exemplary brassiere embodiment 100 according to the present invention. The brassiere 100 generally includes a brassiere base 101 having a back strap 103 and a pair of cups 105 and 107, which are connected in the front by a midsection 109. Underwires 111 and 113 are incorporated within the cups 105 and 107 respectively, along the lower edge thereof, in stitched pockets of the brassiere. Each underwire 111, 113 has a supporting member of three-dimensional form, in the present embodiment provided as support wire 115 deformed in a manner so as to cater a lower profile of the breast of the wearer.

Figure 2:
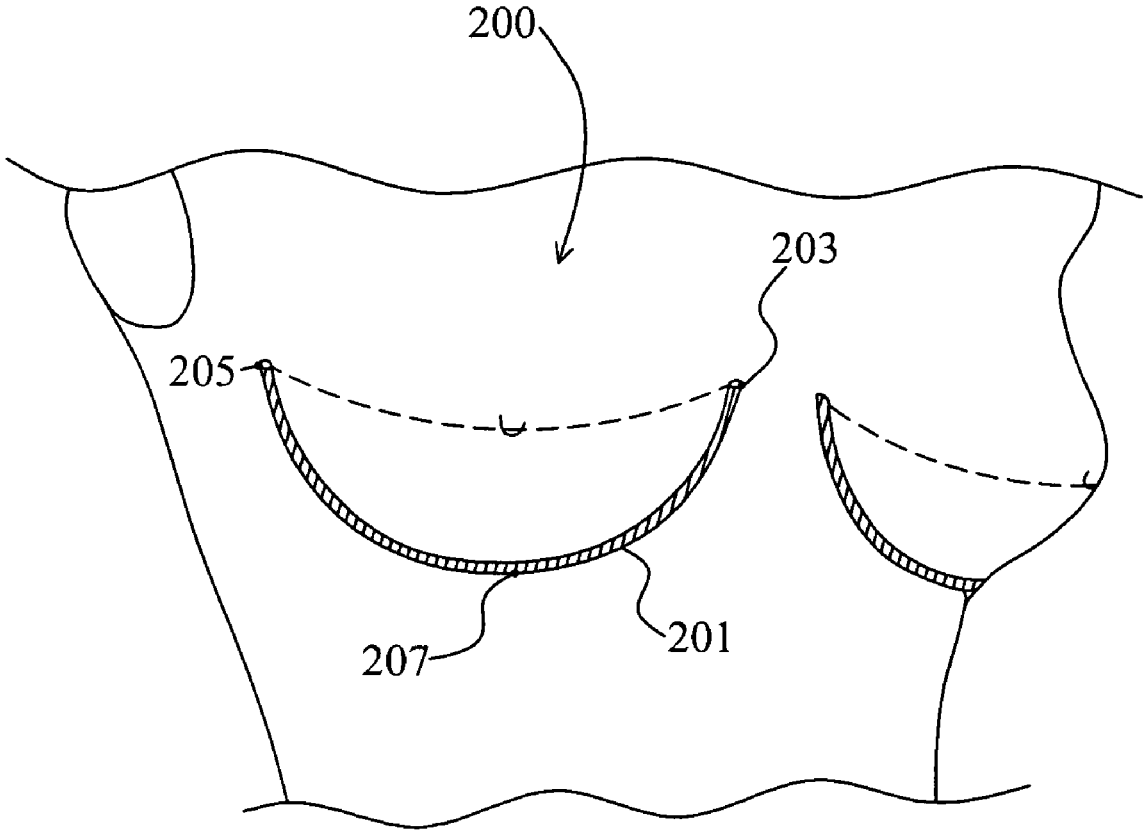
FIG. 2 is a topographic view of a model illustrating the shape of the breast and upper torso of a wearer.

As shown in FIG. 2, each breast 200 of the model as shown has a lower or inferior profile 201 extending from an medial most point 201 to an lateral most point 205 via an inferior most point 207. These three points are generally in different planes to each other, each plane being parallel to the back of the model.

Figure 3:
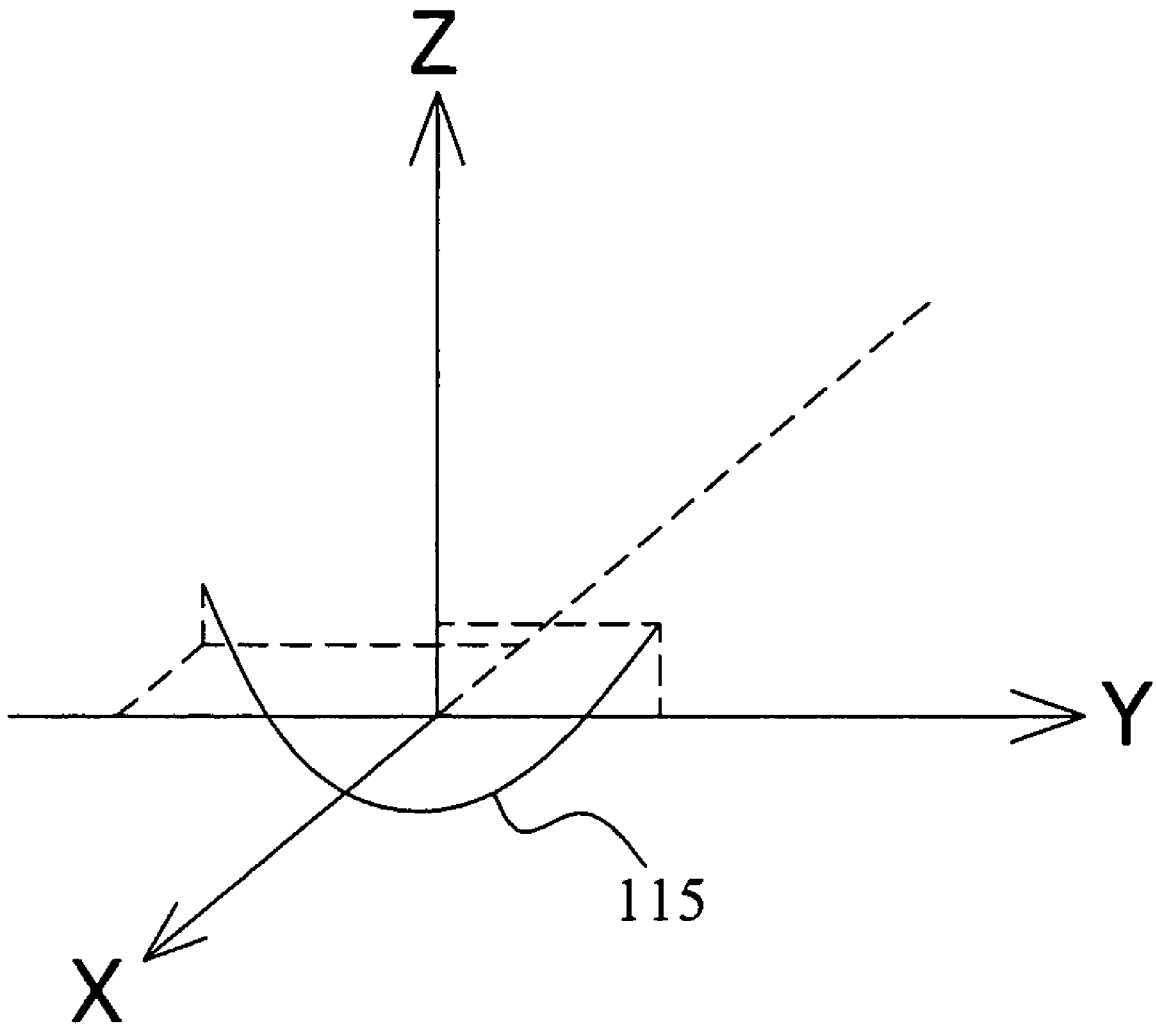
FIG. 3 is a perspective view of a three-dimensional wire of the underwire as shown In FIG. 1.

As shown in FIG. 3, to fit such a low profile 201 and to effectively support the breast of a user, a support wire 115 having a three-dimensional geometry with respect to the longitudinal axis of the wire 115 is provided in each underwire of the exemplary embodiment. The three-dimensional wire 115 is firstly deformed or curved upwardly in a generally U-shape. Furthermore, the support wire 115 is deformed or curved inwardly toward the wearer and thereby extends in at least two planes for catering the lower profile 201 of the breast of a wearer. In the exemplary embodiment, the support wire 115 may be formed from a molded polymer, or metal or metal alloy.

In other or alternate embodiments, shape memory materials such as shape memory polymers including shape memory polyurethanes (SMP) or shape memory metals may be used to form the support wire 115 of the underwire of the brassiere. Alternatively, synthetic resin can be used to form the support wire. In addition, the underwires can be connected at one end for easy fabrication purpose.

In a second exemplary embodiment, the support wire 115 may exhibit a two dimensional U-shape prior to being deformed to extend in at least two planes to conform to the inferior profile of the breast of a wearer, for example, in the use and fitment of the brassiere.

Figure 4:
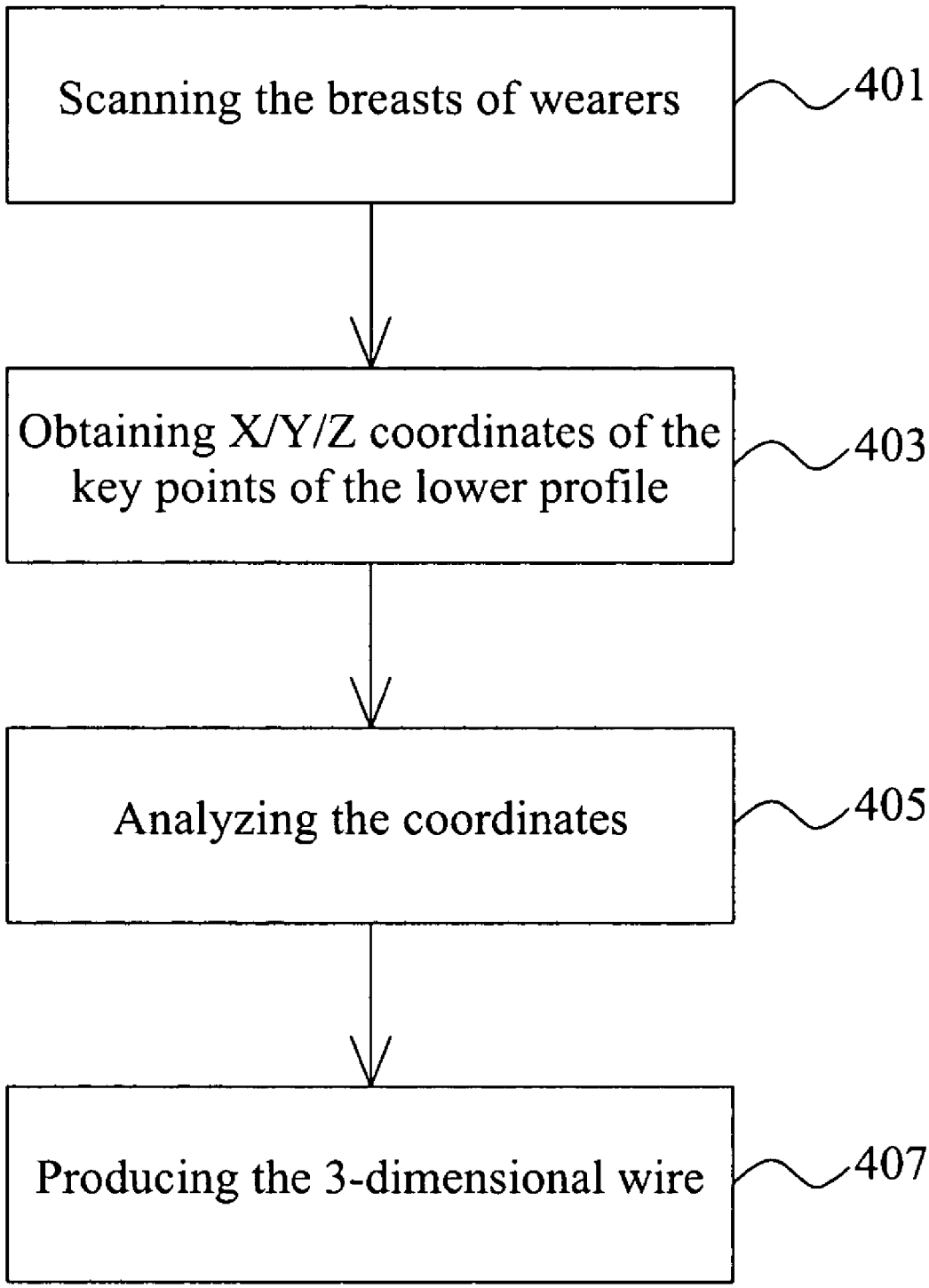
FIG. 4 is a flowchart illustrating a process of producing the brassiere as shown in FIG. 1.

With reference to FIG. 4, a process of producing the support wire 115 of three-dimensional form of the underwire of the brassiere is described.

In step 401, breasts of various sampled individuals are scanned to obtain three-dimensional images by using for example computed tomography (CT) or ISO-C3D three-dimensional medical imaging technologies.

In step 403, coordinates, for example, x, y, z coordinates, of various points along the inferior profile of each breast including, for example, the medial most point, the lateral most point and inferior most point, can be ascertained based upon the scanned three-dimensional images. In an exemplary embodiment, the z-axis extends along the height of the sampled individual, while the y-axis extends along the width of the sample individual. Furthermore, an ordinarily skilled person in the art would appreciate that the coordinates of at least four points along the lower profile are needed for producing a support wire of three-dimensional form for catering for the inferior profile.

In step 405, the coordinates obtained in step 403 are analyzed statistically to ascertain a nominal data, the coordinates of a set of points along the lower profile, for each of different commercial sizes, for example, size 75B, of the breasts.

Figure 5:
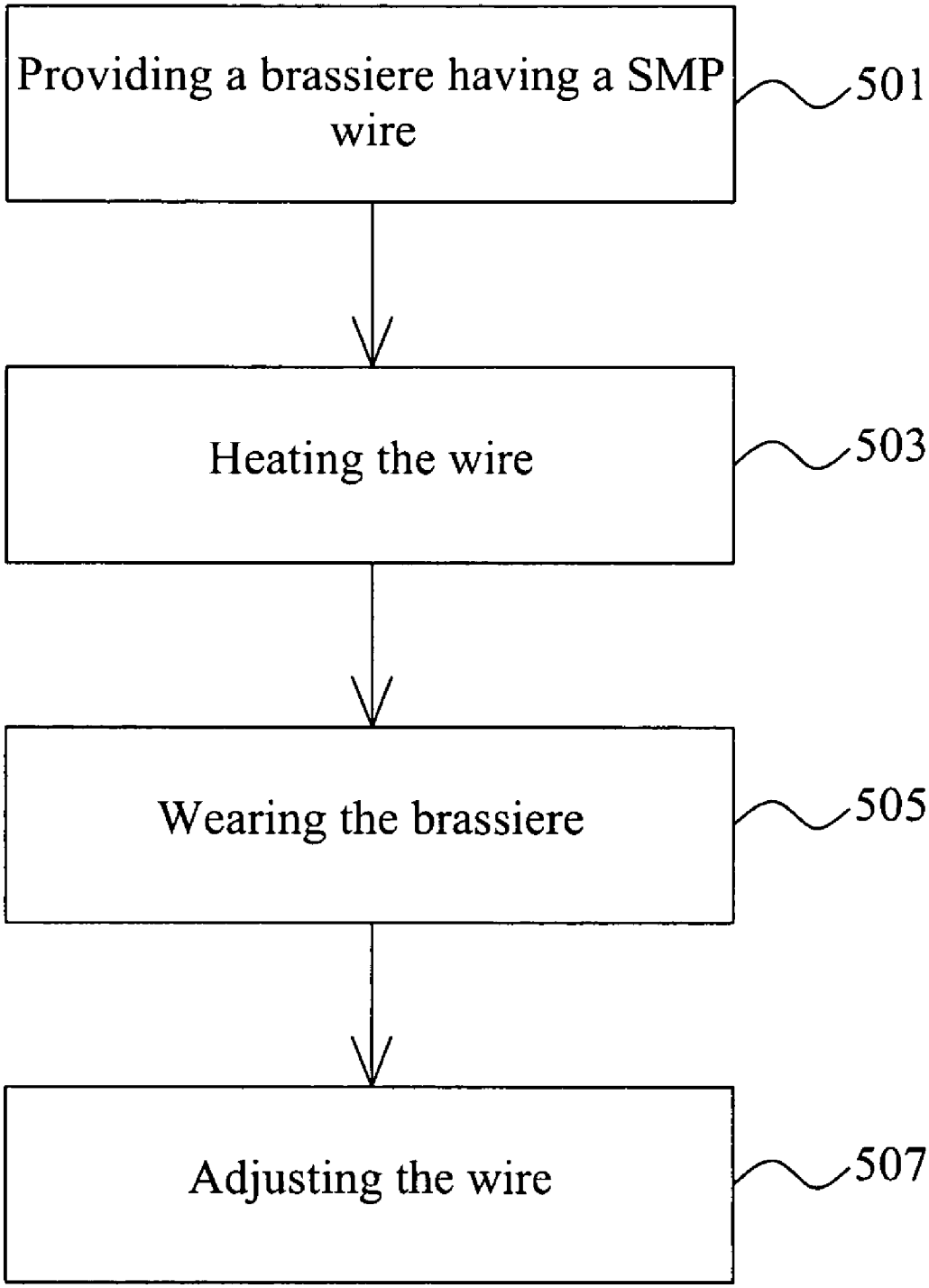
FIG. 5 is a flowchart illustrating a process of wearing a brassiere according to an exemplary embodiment of the present invention.

Thereafter, in step 407, the support wire can by produced based upon the data decided in step 405 by using molding or a stereolithorgraphy technique, for example The use and fitment of the second exemplary embodiment are described with reference to FIG. 5, but it could be understood that the process can also be applied to other embodiments. In step 501, firstly, a brassiere of the second exemplary embodiment having a support wire made from a shape memory polyurethane (SMP) is provided. In step 503, the support wire is heated to a temperature of slightly above the glass transition temperature of the SMP such that the support wire formed by SMP becomes softer and can be plastically deformed. In one exemplary embodiment, the SMP has a glass transition temperature of 40-50° C., which is relatively low in comparison to temperature which would cause discomfort or damage to a wearer. Therefore, in step 505, a wearer can wear the brassiere after the heating whilst the support wire is within its plastic deformation phase without being injured or feeling significant discomfort. As the support wire at this stage would then be at a temperature above its glass transition temperature, in step 507, the wearer may adjust the wire against the side and bottom of the breast, that is, the lower profile, of the wearer's breast. Thereafter, when the temperature of the support wire reduces to a temperature below its glass transition temperature, the wire would be deformed into a generally three-dimensional shape curved upwardly and inwardly. As such, the support wire would then be in a rigid state whilst being deformed to the particular or desired contour of the wearer.

It will be understood that the invention disclosed and defined herein extends to all alternative combinations of two or more of the individual features mentioned or evident from the text or drawings. All of these different combinations constitute various alternative aspects of the invention. The foregoing describes an embodiment of the present invention and modifications, obvious to those skilled in the art can be made thereto, without departing from the scope of the present invention.

Although the invention is illustrated and described herein as embodied, it is nevertheless not intended to be limited to the details described, since various modifications and structural changes may be made therein without departing from the spirit of the invention and within the scope and range of equivalents of the claims.

Furthermore, it will be appreciated and understood that the words used in this specification to describe the present invention and its various embodiments are to be understood not only in the sense of their commonly defined meanings, but also to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself. The definitions of the words or elements of the following claims are, therefore, defined in this specification to include not only the combination of elements which are literally set forth, but all equivalent structure, material or acts for performing substantially the same function in substantially the same way to obtain substantially the same result, without departing from the scope of the invention.

What is claimed is:

1. An underwire assembly for use in a brassiere, said underwire assembly comprising an elongate support member of three-dimensional elongate form, the wire including a shape memory material, said shape memory material being at least one of a shape memory polymer and a shape memory polyurethane, the support member extending in at least two planes for conformity with an inferior profile of a breast of a wearer, said inferior profile being defined by reference to x, y and z coordinates determined by at least one of a computed tomography and an ISO-C3D three-dimensional scanning.

2. The underwire assembly of claim 1, wherein the shape memory polyurethane has a glass transition temperature in a range of about 40° C. to about 50° C.

3. The underwire assembly of claim 1, wherein the wire is formed from a synthetic resin material.

4. An underwire assembly for use in a brassiere, said underwire assembly comprising a generally three-dimensional U-shaped wire including a shape memory material, said shape memory material being at least one of a shape memory polymer and a shape memory polyurethane, the U-shaped wire being deformable to extend in at least two planes to conform to an inferior profile of a breast of a wearer, the inferior profile being defined by reference to x, y and z coordinates determined by at least one of a computed tomography and an JSO-C3D three-dimensional scanning.

5. The underwire assembly of claim 4, wherein the shape memory polyurethane has a glass transition temperature in a range of from about 40° C. to about 50° C.

6. A brassiere comprising a pair of fabric cups joined together at a midsection of the brassiere, each cup including a support wire of three-dimensional form, the support wire including a shape memory material, said shape memory material being at least one of a shape memory polymer and a shape memory polyurethane, the support wire extending in at least two planes so as to conform to an inferior profile of a breast of a wearer, the inferior profile being defined by reference to x, y and z coordinates determined by at least one of a computed tomography and an ISO-C3D three-dimensional scanning.

7. The brassiere of claim 6, wherein the shape memory polyurethane has a glass transition temperature in a range of from about 40° C. to about 50° C.

8. The brassiere of claim 7, wherein the wire is formed from a synthetic resin material.

9. A brassiere comprising a pair of fabric cups joined together at a midsection of the brassiere, each cup including a generally U-shaped wire including a shape memory material, said shape memory material being at least one of a shape memory polymer and a shape memory polyurethane, the U-shaped wire being deformable to extend in at least two planes so as to conform to an inferior profile of a breast of a wearer, the inferior profile being defined by reference to x, y and z coordinates determined by at least one of a computed tomography and an JSO-C3D three-dimensional scanning.

10. The underwire assembly of claim 9, wherein the shape memory polyurethane has a glass transition temperature in a range of from about 40° C. to about 50° C.

11. A process for producing a wire for use in a brassiere, the brassiere including a pair of fabric cups joined together at a midsection of the brassiere, and each cup including a wire of three-dimensional form, which is deformed to extend in at least two planes so as to conform to the inferior profile of a breast of a wearer, the process comprising the steps of:

(i) scanning the breast of the wearer using at least one of a computed tomography and an ISO-C3D three-dimensional scanning technique to determine x, y and z coordinates representative of a surface of the breast; and (ii) deforming the wire in at least two directions with reference to the x, y and z coordinates, each direction being at an angle to each other such that the wire is deformed in three-dimensions in a manner such that the wire conforms to an inferior profile of the breast of a wearer.

12. The process of claim 11, wherein the wire is provided in the form of a shape memory polyurethane.

13. The process of claim 12, wherein the shape memory polyurethane has a glass transition temperature in a range of from about 40° C. to about 50° C.

14. The process of claim 13, further comprising heating the wire to a temperature above its glass transition temperature, the step of heating the wire to a temperature above its glass transition temperature precedes the step of deforming the wire in at least two directions.

15. A process for fitting a brassiere to the body of a user, the brassiere including a pair of fabric cups joined together at a midsection of the brassiere, and each cup including a generally U-shaped wire, wherein the wire is formed from a shape memory material including at least one of a shape memory polymer and a shape memory polyurethane, and the U-shaped wire being deformable to extend in at least two planes so as to conform to an inferior profile of the breast of a wearer, said inferior profile being defined by reference to x, y and z coordinates determined by at least one of a computed tomography and an ISO-C3D three-dimensional scanning technique, the processing comprising:

(i) heating the wire to a temperature above a glass transition temperature of the shape memory material; and (ii) deforming the wire in two directions at an angle to each other such that the wire is deformed in three-dimensions, and (iii) fitting the fabric cups to the body of the user.

16. A process of fitting a brassiere to the body of a user, the process comprising:

(i) scanning the breast of the wearer using at least one of a computed tomography and an ISO-C3D three-dimensional scanning technique to determine x, y and z coordinates representative of a surface of the breast;

(ii) deforming a support wire of a cup of the brassiere in three-dimensions with reference to the x, y and z coordinates so as to conform with an inferior profile of the associated breast of the user; and (iii) fitting the cup to the breast of the user.

17. The process of claim 16, wherein the support wire is provided in the form of a shape memory material.

18. The process of claim 16, wherein the support wire is heated to a temperature above its glass transition temperature prior to being deformed so as to conform with the inferior profile of the associated breast of the user.

19. The method according to claim 18, wherein the shape memory material is a shape memory polyurethane.

* * * * *